US006737387B2

(12) United States Patent
Harrison et al.

(10) Patent No.: US 6,737,387 B2
(45) **Date of Patent: *May 18, 2004**

(54) DISPERSED HYDRATED POTASSIUM BORATE COMPOSITIONS HAVING IMPROVED PROPERTIES IN LUBRICATING OIL COMPOSITIONS

(75) Inventors: James J. Harrison, Novato, CA (US); Kenneth D. Nelson, Clear Lake, CA (US); Juan A. Buitrago, Pinole, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 18 days.

This patent is subject to a terminal disclaimer.

(21) Appl. No.: 10/139,444

(22) Filed: May 2, 2002

(65) Prior Publication Data

US 2003/0211950 A1 Nov. 13, 2003

(51) Int. Cl.[7] ..... C10M 125/26; C10M 141/12

(52) U.S. Cl. ..... 508/158; 508/287; 508/306; 508/506

(58) Field of Search ..... 508/158, 306, 508/287, 506

(56) References Cited

U.S. PATENT DOCUMENTS

| | | | | |
|---|---|---|---|---|
| 3,313,727 | A | 4/1967 | Peeler | 252/18 |
| 3,489,619 | A | 1/1970 | Brewster | 148/29 |
| 3,819,521 | A | 6/1974 | Sims | 252/18 |
| 3,853,772 | A | 12/1974 | Adams | 252/18 |
| 3,912,643 | A | 10/1975 | Adams | 252/49.6 |
| 3,997,454 | A | 12/1976 | Adams | 252/18 |
| 4,089,790 | A | 5/1978 | Adams | 252/18 |
| 4,163,729 | A | 8/1979 | Adams | 252/18 |
| 4,263,155 | A | 4/1981 | Frost | 252/25 |
| 4,401,580 | A | 8/1983 | Frost | 252/25 |
| 4,472,288 | A | 9/1984 | Frost | 252/32.7 |
| 4,534,873 | A | 8/1985 | Clark | 252/32.7 |
| 4,717,490 | A | 1/1988 | Salentine | 252/32.7 |

*Primary Examiner*—Jacqueline V. Howard
(74) *Attorney, Agent, or Firm*—Joseph P. Foley; Claude J. Caroli

(57) ABSTRACT

Disclosed are dispersed hydrated potassium borate compositions, as well as additive packages and finished oil compositions comprising the same. The dispersed hydrated potassium borate compositions of the invention exhibit low turbidity and the finished oil compositions exhibit improved wear performance under high temperature conditions.

14 Claims, No Drawings

DISPERSED HYDRATED POTASSIUM BORATE COMPOSITIONS HAVING IMPROVED PROPERTIES IN LUBRICATING OIL COMPOSITIONS

FIELD OF THE INVENTION

This invention is directed, in part, to novel dispersed hydrated potassium borate compositions, as well as additive packages and finished oil compositions comprising the same. The dispersed hydrated potassium borate compositions of this invention exhibit low turbidity and the finished oil compositions comprising such dispersed hydrated potassium borate compositions exhibit improved wear protection under high temperature conditions.

REFERENCES

The following references are cited in this application as superscript numbers:

[1] Peeler, U.S. Pat. No. 3,313,727, Alkali Metal Borate E P. Lubricants, issued Apr. 11, 1967

[2] Adams, U.S. Pat. No. 3,912,643, Lubricant Containing Nelutralized Alkali Metal Borates, issued Oct. 14, 1975

[3] Sims, U.S. Pat. No. 3,819,521, Lubricant Containing Dispersed Borate and a Polyol, issued Jun. 25, 1974

[4] Adams, U.S. Pat. No. 3,853,772, Lubricant Containing Alkali Metal Borate Dispersed with a Mixture of Dispersants, issued Dec. 10, 1974

[5] Adams, U.S. Pat. No. 3,997,454, Lubricant Containing Potassium Borate, issued Dec. 14, 1976

[6] Adams, U.S. Pat. No. 4,089,790, Synergistic Combinations of Hydrated Potassium Borate, Antiwear Agents, and Organic Sulfide Antioxidants, issued May 16, 1978

[7] Adams, U.S. Pat. No. 4,163,729, Synergistic Combinations of Hydrated Potassium Borate, Antiwear Agents, and Organic Sulfide Antioxidants, issued Aug. 7, 1979

[8] Frost, U.S. Pat. No. 4,263,155, Lubricant Composition Containing an Alkali Metal Borate and Stabilizing Oil-Soluble Acid, issued Apr. 21, 1981

[9] Frost, U.S. Pat. No. 4,401,580, Lubricant Composition Containing an Alkali Metal Borate and an Ester-Polyol Compound, issued Aug. 30, 1983

[10] Frost, U.S. Pat. No. 4,472,288, Lubricant Composition Containing an Alkali Metal Borate and an Oil-Soluble Amine Salt of a Phosphorus Compound, issued Sep. 18, 1984

[11] Clark, U.S. Pat. No. 4,534,873, Automotive Friction Reducing Composition, issued Aug. 13, 1985

[12] Brewster, U.S. Pat. No. 3,489,619, Heat Transfer and Quench Oil, issued Jan. 13, 1970

[13] Salentine, U.S. Pat. No. 4,717,490, Synergistic Combination of Alkali Metal Borates, Sulfur Compounds, Phosphites and Neutralized Phosphate, issued Jan. 5, 1988

All of the above patents are herein incorporated by reference in their entirety to the same extent as if each individual patent was specifically and individually indicated to be incorporated by reference in its entirety.

STATE OF THE ART

High load conditions often occur in gear sets such as those used in automobile transmissions and differentials, pneumatic tools, gas compressors, centrifuges, high-pressure hydraulic systems, metal working and similar devices, as well as in many types of bearings. When employed in such environments, it is conventional to add an extreme-pressure (E.P.) agent to the lubricant composition and, in this regard, alkali metal borates are well known extreme-pressure agents for such compositions.[1-11, 13] E.P. agents are added to lubricants to prevent destructive metal-to-metal contact in the lubrication of moving surfaces. While under normal conditions termed "hydrodynamic", a film of lubricant is maintained between the relatively moving surfaces governed by lubricant parameters, and principally viscosity. However, when load is increased, clearance between the surfaces is reduced, or when speeds of moving surfaces are such that the film of oil cannot be maintained, the condition of "boundary lubrication" is reached; governed largely by the parameters of the contacting surfaces. At still more severe conditions, significant destructive contact manifests itself in various forms such as wear and metal fatigue as measured by ridging and pitting. It is the role of E.P. additives to prevent this from happening. For the most part, E.P. agents have been oil soluble or easily dispersed as a stable dispersion in the oil, and largely have been organic compounds chemically reacted to contain sulfur, halogen (principally chlorine), phosphorous, carboxyl, or carboxylate salt groups which react with the metal surface under boundary lubrication conditions. Stable dispersions of hydrated metal borates have also been found to be effective as E.P. agents.

Gear sets have been subject to ever increasing demands including requirements for satisfactory performance at high temperatures, e.g., greater than 135° C. and preferably at least 163° C. In turn, this has placed an ever increasing requirement that the E.P. lubricant composition employed in such gear sets provide satisfactory wear and metal fatigue as measured by ridging and pitting requirements of the gear set when evaluated at such high temperatures.

In addition, because hydrated alkali metal borates are insoluble in lubricant oil media, it is necessary to incorporate the borate as a dispersion in the oil and homogenous dispersions are particularly desirable. The degree of formation of a homogenous dispersion can be correlated to the turbidity of the oil after addition of the hydrated alkali metal borate with higher turbidity correlating to less homogenous dispersions. In order to facilitate formation of such a homogenous dispersion, it is conventional to include a dispersant in such compositions. Examples of dispersants include lipophilic surface-active agents such as alkenyl succinimides or other nitrogen containing dispersants as well as alkenyl succinates.[1-4, 12] It is also conventional to employ the alkali metal borate at particle sizes of less than 1 micron in order to facilitate the formation of the homogenous dispersion.[11] Notwithstanding the use of such additives, lubricant compositions comprising such potassium borates can possess unacceptable turbidity.

In view of the above, lubricant compositions comprising a hydrated potassium borate and which possessed low turbidity and acceptable wear and fatigue properties as measured by pitting and ridging, especially when the gear set is operated at high temperature, would be particularly advantageous.

SUMMARY OF THE INVENTION

This invention is directed to the novel and unexpected discovery that reduced wear and fatigue as measured by ridging and pitting in gear sets can be achieved by the use of a lubricant composition comprising a dispersed hydrated potassium borate composition having a specific degree of dehydration.

In addition, this invention is directed to the novel and unexpected discovery that these compositions exhibit acceptable turbidity as evidenced by a turbidity value of less than 300 ntu.

Accordingly, in one of its composition aspects, this invention is directed to a dispersed hydrated potassium borate composition comprising a hydrated potassium borate, a dispersant, optionally a detergent, and an oil of lubricating viscosity wherein said dispersed hydrated potassium borate composition is characterized by a hydroxyl:boron ratio (OH:B) of from at least 1.2:1 to 2.2:1, a potassium to boron ratio of from about 1:2.75 to 1:3.25 and a turbidity value of less than 300 ntu.

In one preferred embodiment, the hydroxyl:boron ratio is from about 1.3:1 to 2.1:1; more preferably, from about 1.3:1 to 2.0:1; and even more preferably, from about 1.3:1 to 1.9:1.

In another preferred embodiment, the dispersed potassium borate compositions described herein have a turbidity of less than about 75 ntu, more preferably, less than about 60 ntu, and still more preferably, less than about 40 ntu.

In still another preferred embodiment, the dispersed hydrated potassium borate composition has a potassium to boron metal ratio of from about 1:2.9 to about 1:3.1 and more preferably about 1:3.

In yet another preferred embodiment, the dispersed hydrated potassium borate composition has an average particle size of less than about 0.6 microns and more preferably from about 0.10 to about 0.30 microns.

Optionally, the dispersed potassium borate compositions contain small amounts of a water-soluble oxo anion. Only from 0.001 moles to 0.11 moles of water soluble oxo anion should be present per mole of boron atom. This water-soluble oxo anion can include nitrate, sulfate, carbonate, phosphate, pyrophosphate, silicate, aluminate, germanate, stannate, zincate, plumbate, titanate, molybdate, tungstate, vanadate, niobate, tantalate, uranates, or can include the isopolymolybdates and isopolytungstates, or the heteropolymolybdates and heteropolytungstates, or mixtures thereof.

Preferably the dispersant in said potassium borate compositions is selected from the group consisting of a polyalkylene succinimide, a polyalkylene succinic anhydride, a polyalkylene succinic acid, a mono- or di-salt of a polyalkylene succinic acid and mixtures thereof. Optionally, the dispersed potassium borate composition contains a detergent such as a metal sulfonate, preferably an alkylaromatic or polyisobutenyl calcium sulfonate or other Group II metal sulfonate that acts in these compositions to help provide for a homogeneous dispersion.

Another aspect of this invention is directed to additive packages comprising from about 10 to 80 weight percent of the dispersed hydrated potassium borate composition described above and from about 90 to 20 weight percent of one or more of conventional additives selected from the group consisting of ashless dispersants (0–10%), detergents (0–5%), sulfurized hydrocarbons (0–40%), dialkyl hydrogen phosphates (0–15%), zinc dithiophosphates (0–20%), alkyl ammonium phosphates and/or thio- dithiophosphates (0–20%), phosphites (0 to 10%), fatty acid esters of polyalcohols (0–10%), 2,5-dimercaptothiadiazole (0–5%), benzotriazole (0–5%), dispersed molybdenum disulfide (0–5%), foam inhibitors (0–2%), and imidazolines (0–10%) and the like wherein each weight percent is based on the total weight of the composition. It is understood, of course, that the addition of such conventional additives will dilute the concentration of the hydrated potassium borate, dispersant and oil of lubricating viscosity in the dispersed hydrated potassium borate composition.

Such additive packages can be added in effective amounts to an oil of lubricating viscosity to form a finished oil composition. Accordingly, the finished oil compositions of this invention contain the additive packages as described above upon further blending with an oil of lubricating viscosity. Preferably, the additive package described above, in an amount of from about 2 to 15 weight percent, is added to an oil of lubricating viscosity, in the amount of from about 85 to 98 weight percent, to provide for the finished gear oil composition wherein the weight percent of each component is based on the total weight of the composition. More preferably, added along with the oil of lubricating viscosity is a viscosity index improver which is included at a level of 0–12% and/or a pour point depressant at a level of 0–1%, to form a finished oil wherein the weight percent of each of the viscosity index improver and pour point depressant is based on the total weight of the composition.

In one of its method aspects, this invention is directed to a method for inhibiting gear damage, as measured by reduced wear and metal fatigue associated with ridging and pitting, during operation of a gear set at a temperature of at least 163° C. which method comprises operating said gear set with a dispersed, hydrated, potassium borate composition comprising:

a hydrated potassium borate, a dispersant, optionally a detergent, and an oil of lubricating viscosity wherein the dispersed hydrated potassium borate composition is characterized by a hydroxyl:boron ratio (OH:B) of from at least 1.2:1 to 2.2:1, a potassium to boron ratio of from about 1:2.75 to 1:3.25 and a turbidity value of less than 300 ntu,.

When said gear set is operated at a temperature of 163° C. over at least 8 hours, reduced gear damage, as measured by gear wear and pitting is observed.

This invention is also directed to a method for providing lower turbidity for dispersed hydrated potassium borate compositions which method comprises carefully controlling the hydroxyl:boron ratio (OH:B) of the dispersed hydrated potassium borate composition in the range of from at least 1.2:1 to 2.2:1, and preferably from about 1.3:1 to 2.1:1 and a potassium to boron ratio of from about 1:2.75 to 1:3.25.

This invention is still further directed to a method for the preparation of such dispersed hydrated potassium borate compositions which comprises:

mixing, under agitation, a mixture of an aqueous solution of boric acid and potassium hydroxide, where the stoichiometric ratio of the boric acid and the potassium hydroxide are selected to provide for a potassium to boron ratio in the product of from about 1:2.75 to 1:3.25, with an oil of lubricating viscosity and a dispersant, and then heating the mixture to remove sufficient water so as to produce a dispersed hydrated potassium borate composition having a OH:B ratio of from at least 1.2:1 to 2.2:1 and, preferably, from about 1.3:1 to about 2.1:1.

DETAILED DESCRIPTION OF THE INVENTION

This invention is directed, in part, to novel dispersed hydrated potassium borate compositions comprising a hydrated potassium borate, a dispersant, optionally a detergent, and an oil of lubricating viscosity wherein said dispersed hydrated potassium borate composition is characterized by a hydroxyl:boron ratio (OH:B) of from at least 1.2:1 to 2.2:1, a potassium to boron ratio of from about 1:2.75 to 1:3.25 and a turbidity value of less than 300 ntu.

Each of these components in the claimed composition will be described in detail herein. However, prior to such a description, the following terms will first be defined.

The term "hydroxyl:boron ratio" or "OH:B" refers to a ratio of the number of hydroxyl groups attached to boron (moles of hydroxyl groups per mole of boron) in the dispersed hydrated potassium borate compositions as exemplified by, for example, structural formula I below. Another way to define the term "hydroxyl:boron ratio" is to consider the formula:

$$K_2O.xB_2O_3.yH_2O$$

where x is between 2.75 and 3.25 and y is between 3.3 and 7.15, wherein the ratio of y to x is from at least 1.2:1 to 2.2:1, this ratio of y to x is the "hydroxyl:boron ratio". Preferably, this ratio is from about 1.3:1 to 2.1:1.

For the purposes of this application, the OH:B ratio of a dispersed hydrated potassium borate composition is calculated from the maximum infra-red (IR) absorbance between 3800 and 3250 $cm^{-1}$ (corrected by subtracting the baseline which is taken to be the absorbance at 3900 $cm^{31\ 1}$) of a 5.000% solution, in a 0.215 mm transmittance cell, of the dispersed hydrated potassium borate composition in an oil of lubricating viscosity wherein all interfering absorbances due to other compounds or impurities have been subtracted. The remaining absorbance in this range corresponds to the hydroxyl groups of the dispersed hydrated potassium borate composition which is then converted to the OH:B ratio as follows:

$$OH:B=23.0A_{max}/\%B$$

where $A_{max}$ is the baseline corrected maximum IR absorbance (peak height)in the region 3800–3250 $cm^{-1}$; and %B is the percent boron in the original (non-diluted) dispersed hydrated potassium borate composition sample.

The absorbance in this range, 3800 to 3250 $cm^{-1}$, corresponds to the hydroxyl groups of the potassium borate oligomer complex. If other additives are added to mask or interfere with the absorbance within this preferred range such groups will be subtracted from the IR spectra in the initial calculation of the OH:B ratio calculation.

In the examples below, this absorbance was measured with a Nicolet 5DXB FTIR Spectrometer fitted with a DTGS detector and CsI beam splitter. The spectrometer had $CaF_2$ windows with 0.215 mm Teflon® spacer with small section cut out and a suitable cell holder. A spectrum of the sample was obtained using a 4 $cm^{-1}$ resolution.

The dispersed hydrated potassium borate composition preferably includes those compositions comprising from about 10 to 75 weight percent of the hydrated potassium borate; from about 2 to 40 weight percent of a dispersant; and from about 30 to 70 weight percent of an oil of lubricating viscosity, all based on the total weight of the composition. These compositions can be diluted to provide for an "additive package" as described above which, in turn, can be further diluted to provide for a fully formulated finished oil that is also described above.

Hydrated Potassium Borate

Hydrated potassium metal borates are well known in the art. Representative patents disclosing suitable borates and methods of manufacture include: U.S. Pat. Nos.3,313,727; 3,819,521; 3,853,772; 3,912,643; 3,997,454; and 4,089,790.[1-6]

These potassium metal borates can generally be represented by the following theoretical structural formula I:

I

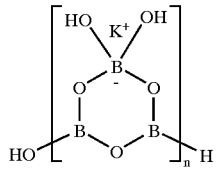

where n is a number preferably from 1.0 to about 10.

In the compositions of this invention, the specific ratio of potassium to boron is limited to a range from about 1:2.75 to 1:3.25 and the specific ratio of hydroxyl to boron is from at least 1.2:1 to 2.2:1.

Dispersed alkali metal borate compositions comprising hydrated potassium metal borates are generally prepared by forming, in deionized water, a solution of potassium hydroxide and boric acid optionally in the presence of a small amount of potassium carbonate. The solution is then added to a lubricant composition comprising an oil of lubricating viscosity, a dispersant and any optional additives to be included therein (e.g., a detergent, sulfur containing compounds such as 2,2'-thiodiethanol, and the like, and other optional additives) to form an emulsion that is then dehydrated. Dehydration proceeds in three steps including an initial step of water removal that is initiated at a temperature of slightly over 100° C. This initial step is followed by a slow increase in temperature whereupon the emulsion changes from turbid to clear. In the final step, there is a rapid increase in temperature and the liquid once again becomes turbid.

Formation of the hydrated potassium borates described herein is achieved by stoichiometric selection of the appropriate amounts of potassium hydroxide and boric acid and control of the extent of dehydration such that the resulting product has a ratio of potassium to boron in the range from about 1:2.75 to 1:3.25, a ratio of hydroxyl to boron of from at least 1.2:1 to 2.2:1, and a turbidity of less than 300 ntu.

In this invention, it was discovered that unexpected properties resulted when the degree of dehydration was carefully controlled to provide for a hydroxyl to boron ratio of from at least 1.2:1 to 2.2:1, and preferably from about 1.3:1 to 2.1:1. It was also discovered that unexpected properties resulted when the ratio of potassium to boron was carefully controlled to provide for a potassium to boron ratio of from about 1:2.75 to 1:3.25. Because of their retention of hydroxyl groups on the borate complex, these complexes are referred to as "hydrated potassium borates" and compositions containing oil/water emulsions of these hydrated potassium borates are referred to as "dispersed hydrated potassium borate compositions".

As stated above, the dehydration of the reaction mixture is closely monitored to ensure that the resulting dispersed hydrated potassium borate concentrate has a hydroxyl to boron ratio of from at least 1.2:1 to 2.2:1 when the reaction mixture is ultimately returned to a temperature of about 0° C. to about 50° C. and more preferably from about 20° C. to 45° C. In addition, related to a method aspect of the present invention, the dehydration procedure is carefully controlled (i.e., using a slower dehydration rate, employing a sweep gas, and the like) in order to avoid condensation of water on the walls of the reaction chamber. Condensation can result in water droplets in the lubricant composition which, in turn, may lead to undesired precipitate formation. Such precipitate formation typically results in large particles that must be filtered from the composition. Accordingly, in a preferred embodiment of this invention, dehydration occurs over a period of from about 1 to 10 hours, more preferably 3 to 8 hours. Optimization of the time, temperature and rate of air flow gives the preferred reaction design.

Preferred dispersed potassium borate compositions have a potassium-to-boron ratio of about 1:2.75 to 1:3.25 and more preferably 1:2.9 to about 1:3.1, and even more preferably about 1:3. In another of its preferred embodiments, the hydrated potassium borate particles generally have a mean particle size of less than 1 micron. In this regard, it has been found that the dispersed potassium borate compositions of this invention preferably have a particle size where 90% or greater of the particles are less than 0.6 microns.

In the dispersed hydrated potassium borate compositions, the hydrated potassium borates will generally comprise about 10 to 75 weight percent, preferably 25 to 50 weight percent, more preferably about 35 to 40 weight percent of the composition. (Unless otherwise stated, all percentages are in weight percent.)

Optionally, the dispersed potassium borate compositions contain small amounts of a water soluble oxo anion. Only from 0.001 moles to 0.11 moles of water soluble oxo anion should be present per mole of boron atom. This water-soluble oxo anion can include nitrate, sulfate, carbonate, phosphate, pyrophosphate, silicate, aluminate, germanate, stannate, zincate, plumbate, titanate, molybdate, tungstate, vanadate, niobate, tantalate, uranates, or can include the isopolymolybdates and isopolytungstates, or the heteropolymolybdates and heteropolytungstates, or mixtures thereof.

The presence of small amounts of water soluble oxo anions in the potassium borate lubricants is thought to improve the water tolerance of the potassium borates by disrupting the crystal structure of the hydrolysis products. This results in a lower tendency to form crystals or in a reduced rate of crystallization.

The additive packages and lubricant compositions of this invention can further employ surfactants, detergents, other dispersants and other conditions as described below and known to those skilled in the art. Optionally, the additive packages contain an alkylaromatic or polyisobutenyl sulfonate.

The dispersed hydrated potassium borate compositions of this invention generally comprise a dispersant, detergent and oil of lubricating viscosity that are further detailed below.

The Dispersant

The dispersant employed in the compositions of this invention can be ashless dispersants such as an alkenyl succinimide, an alkenyl succinic anhydride, an alkenyl succinate ester, and the like, or mixtures of such dispersants.

Ashless dispersants are broadly divided into several groups. One such group is directed to copolymers which contain a carboxylate ester with one or more additional polar function, including amine, amide, imine, imide, hydroxyl carboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethy methacrylate copolymers and the like. Additionally, high molecular weight amides and polyamides or esters and polyesters such as tetraethylene pentamine, polyvinyl polysterarates and other polystearamides may be employed. Preferred dispersants are N-substituted long chain alkenyl succinimides.

Alkenyl succinimides are usually derived from the reaction of alkenyl succinic acid or anhydride and alkylene polyamines. These compounds are generally considered to have the formula

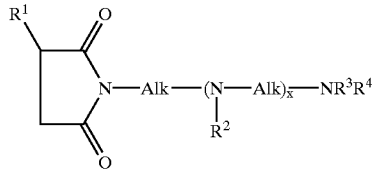

wherein $R^1$ is a substantially hydrocarbon radical having a molecular weight from about 400 to 3000, that is, $R^1$ is a hydrocarbyl radical, preferably an alkenyl radical, containing about 30 to about 200 carbon atoms; Alk is an alkylene radical of 2 to 10, preferably 2 to 6, carbon atoms, $R^2$, $R^3$, and $R^4$ are selected from a $C_1$–$C_4$ alkyl or alkoxy or hydrogen, preferably hydrogen, and x is an integer from 0 to 10, preferably 0 to 3. The actual reaction product of alkylene succinic acid or anhydride and alkylene polyamine will comprise the mixture of compounds including succinamic acids and succinimides. However, it is customary to designate this reaction product as a succinimide of the described formula, since this will be a principal component of the mixture. See, for example, U.S. Pat. Nos. 3,202,678; 3,024,237; and 3,172,892.

These N-substituted alkenyl succinimides can be prepared by reacting maleic anhydride with an olefinic hydrocarbon followed by reacting the resulting alkenyl succinic anhydride with the alkylene polyamine. The $R^1$ radical of the above formula, that is, the alkenyl radical, is preferably derived from a polymer prepared from an olefin monomer containing from 2 to 5 carbon atoms. Thus, the alkenyl radical is obtained by polymerizing an olefin containing from 2 to 5 carbon atoms to form a hydrocarbon having a molecular weight ranging from about 400 to 3000. Such olefin monomers are exemplified by ethylene, propylene, 1-butene, 2-butene, isobutene, and mixtures thereof.

The preferred polyalkylene amines used to prepare the succinimides are of the formula:

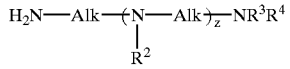

wherein z is an integer of from 0 to 10 and Alk, $R^2$, $R^3$, and $R^4$ are as defined above.

The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl) imidazoline,1-(2-aminopropyl)-piperazine, 1,4-bis(2-aminoethyl)piperazine and 2-methyl-1-(2-aminobutyl) piperazine. Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898–905 (Interscience Publishers, New York, 1950).

The term "ethylene amine" is used in a generic sense to denote a class of polyamines conforming for the most part to the structure $$H_2N(CH_2CH_2NH)_aH$$

wherein a is an integer from 1 to 10.

Thus, it includes, for example, ethylene diamine, diethylene triamine, triethylene tetraamine, tetraethylene pentamine, pentaethylene hexamine, and the like.

Also included within the term "alkenyl succinimides" are post-treated succinimides such as post-treatment processes involving ethylene carbonate disclosed by Wollenberg, et al., U.S. Pat. No. 4,612,132; Wollenberg, et al., U.S. Pat. No. 4,746,446; and the like as well as other post-treatment processes each of which are incorporated herein by reference in its entirety.

Preferably, the polyalkylene succinimide component comprises from 2 to 40 weight percent, more preferably 5–20 weight percent, and even more preferably 10 to 15 weight percent, of the weight of the dispersed, hydrated potassium borate composition.

Polyalkylene succinic anhydrides or a non-nitrogen containing derivative of the polyalkylene succinic anhydride (such as succinic acids, Group I and/or Group II mono- or di-metal salts of succinic acids, succininate esters formed by the reaction of a polyalkylene succinic anhydride, acid chloride or other derivative with an alcohol, and the like) are also suitable dispersants for use in the compositions of this invention.

The polyalkylene succinic anhydride is preferably a polyisobutenyl succinic anhydride. In one preferred embodiment, the polyalkylene succinic anhydride is a polyisobutenyl succinic anhydride having a number average molecular weight of at least 500, more preferably at least 900 to about 3000 and still more preferably from at least about 900 to about 2300.

In another preferred embodiment, a mixture of polyalkylene succinic anhydrides is employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 500 to below 1000 and the high molecular weight component has a number average molecular weight of from 1000 to about 3000. Still more preferably, both the low and high molecular weight components are polyisobutenyl succinic anhydrides.

Alternatively, various molecular weights polyalkylene succinic anhydride components can be combined as a dispersant as well as a mixture of the other above referenced dispersants as identified above.

As noted above, the polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation.

Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. EP 355 895; terpolymer PIBSA described in U.S. Pat. No. 5,792,729; sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863. The disclosures of each of these documents are incorporated herein by reference in their entirety.

Preferably, the polyalkylene succinic anhydride component comprises from 2 to 40 weight percent, more preferably 5 to 20 weight percent, and even more preferably 10 to 15 weight percent, of the weight of the dispersed hydrated potassium borate composition.

Typically, in the dispersed hydrated potassium borate composition, the hydrated potassium borate is in a ratio of at least 2:1 relative to the polyalkylene succinic anhydride dispersant, while preferably being in the range of 2:1 to 10:1. In a more preferred embodiment the ratio is at least 5:2. In another preferred embodiment, mixtures as defined above of the polyalkylene succinic anhydrides are employed.

A particularly preferred combination of dispersants include a mixture of a polyalkylene succinic anhydride and a calcium polyisobutenyl sulfonate, especially those made from highly reactive polyisobutenes. Such mixtures are disclosed, for example, in U.S. patent application Ser. No. 09/967,049, filed on Sep. 28, 2001 and entitled "LUBRICANT COMPOSITION COMPRISING ALKALI METAL BORATE DISPERSED IN A POLYALKYLENE SUCCINIC ANHYDRIDE AND A METAL SALT OF A POLYISOBUTENYL SULFONATE", which application is incorporated herein by reference in its entirety.

The Detergent

The compositions of the present invention may optionally contain a detergent. There are a number of materials that are suitable as detergents for the purpose of this invention. These materials include phenates (high overbased or low overbased), high overbased phenate stearates, phenolates, salicylates, phosphonates, thiophosphonates and sulfonates and mixtures thereof. Preferably, sulfonates are used, such as high overbased sulfonates, low overbased sulfonates, or phenoxy sulfonates. In addition the sulfonic acids themselves can also be used.

The sulfonate detergent is preferably an alkali or alkaline earth metal salt of a hydrocarbyl sulfonic acid having from 15 to 200 carbons. Preferably the term "sulfonate" encompasses the salts of sulfonic acid derived from petroleum products. Such acids are well known in the art. They can be obtained by treating petroleum products with sulfuric acid or sulfur trioxide. The acids thus obtained are known as petroleum sulfonic acids and the salts as petroleum sulfonates. Most of the petroleum products which become sulfonated contain an oil-solubilizing hydrocarbon group. Also included within the meaning of "sulfonate" are the salts of sulfonic acids of synthetic alkyl aryl compounds. These acids also are prepared by treating an alkyl aryl compound with sulfuric acid or sulfur trioxide. At least one alkyl substituent of the aryl ring is an oil-solubilizing group, as discussed above. The acids thus obtained are known as alkyl aryl sulfonic acids and the salts as alkyl aryl sulfonates. The sulfonates where the alkyl is straight-chain are the well-known linear alkylaryl sulfonates.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. The sulfonates can then be overbased, although, for purposes of this invention, overbasing is not necessary. Overbased materials and methods of preparing such materials are well known to those skilled in the art. See, for example, LeSuer U.S. Pat. No. 3,496,105, issued Feb. 17, 1970, particularly Cols. 3 and 4.

The sulfonates are present in the lubricating oil composition in the form of alkali and/or alkaline earth metal salts, or mixtures thereof. The alkali metals include lithium, sodium and potassium. The alkaline earth metals include magnesium, calcium and barium, of which the latter two are preferred.

Particularly preferred, however, because of their wide availability, are salts of the petroleum sulfonic acids, particularly the petroleum sulfonic acids which are obtained by sulfonating various hydrocarbon fractions such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid which may or may not be alkylated; and the like.

The preferred salts for use in the present invention are those of alkylated aromatic sulfonic acids in which the alkyl radical or radicals contain at least about 8 carbon atoms, for example from about 8 to 22 carbon atoms. Another preferred group of sulfonate starting materials are the aliphatic-substituted cyclic sulfonic acids in which the aliphatic substituents or substituents contain a total of at least 12 carbon atoms, such as the alkyl aryl sulfonic acids, alkyl cycloaliphatic sulfonic acids, the alkyl heterocyclic sulfonic acids and aliphatic sulfonic acids in which the aliphatic radical or radicals contain a total of at least 12 carbon atoms. Specific examples of these oil-soluble sulfonic acids include petroleum sulfonic acid, petrolatum sulfonic acids, mono- and poly-wax-substituted naphthalene sulfonic acids, substituted sulfonic acids, such as cetyl benzene sulfonic acids, cetyl phenyl sulfonic acids, and the like, aliphatic sulfonic acid, such as paraffin wax sulfonic acids, hydroxy-substituted paraffin wax sulfonic acids, etc., cycloaliphatic sulfonic acids, petroleum naphthalene sulfonic acids, cetyl cyclopentyl sulfonic acid, mono- and poly-wax-substituted cyclohexyl sulfonic acids, and the like. The term "petroleum sulfonic acids" is intended to cover all sulfonic acids that are derived directly from petroleum products.

Typical Group II metal sulfonates suitable for use in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc. The concentration of metal sulfonate that may be employed may vary over a wide range, depending upon the concentration of potassium borate particles. When present, however, the detergent concentration will generally range from 0.2 to about 10 weight percent and preferably from 3 to 7 weight percent. In addition, the compositions of this invention may contain a mixture of both a metal sulfonate and an ashless dispersant, as described above, where the ratio is a factor of achieving the proper stability of the hydrated, dispersed borate composition.

The Oil of Lubricating Viscosity

The lubricating oil to which the hydrated potassium borates and the dispersant are added can be any hydrocarbon-based lubricating oil or a synthetic base oil stock. Likewise, these lubricating oils can be added to the dispersed potassium borate compositions and additive packages containing them, as described herein, to form finished oil compositions. The hydrocarbon-based lubricating oils may be derived from synthetic or natural sources and may be paraffinic, naphthetic or asphaltenic base, or mixtures thereof. The diluent oil can be natural or synthetic, and can be different viscosity grades.

The lubricating oil comprises from 30 to 70 weight percent, more preferably from 45 to 55 weight percent, based on the total weight of the dispersed hydrated potassium borate composition.

Formulations

The dispersed hydrated potassium borate compositions of the present invention (as described herein above) are generally blended to form additive packages comprising such dispersed hydrated potassium borate compositions. These additive packages typically comprise from about 10 to 80 weight percent of the dispersed hydrated potassium borate composition described above and from about 90 to 20 weight percent of one or more of conventional additives selected from the group consisting of ashless dispersants (0–10%), detergents (0–5%), sulfurized hydrocarbons (0–40%), dialkyl hydrogen phosphates (0–15%), zinc dithiophosphates (0–20%), alkyl ammonium phosphates and/or thio- dithiophosphates (0–20%), phosphites (0–10%) pentaerythritol monooleate (0–10%), 2,5-dimercaptothiadiazole (0–5%), benzotriazole (0–5%), dispersed molybdenum disulfide (0–5%), foam inhibitors (0–2%), and imidazolines (0–10%) and the like wherein each weight percent is based on the total weight of the composition. It is understood, of course, that the addition of such conventional additives will dilute the concentration of the hydrated potassium borate, dispersant and oil of lubricating viscosity in the dispersed hydrated potassium borate composition.

Fully formulated finished oil compositions of this invention can be formulated from these additive packages upon further blending with an oil of lubricating viscosity. Preferably, the additive package described above is added to an oil of lubricating viscosity in an amount of from about 2 to 15 weight percent to provide for the finished oil composition wherein the weight percent of the additive package is based on the total weight of the composition. More preferably, added along with the oil of lubricating viscosity is a viscosity index improver which is included at a level of 0–12% and/or a pour point depressant at a level of 0–1%, to form a finished oil wherein the weight percent of each of the viscosity index improver and pour point depressant is based on the total weight of the composition.

A variety of other additives can be present in lubricating oils of the present invention. Those additives include antioxidants, rust inhibitors, corrosion inhibitors, extreme pressure agents, antifoam agents, other viscosity index improvers, other anti-wear agents, and a variety of other well-known additives in the art.

EXAMPLES

The invention will be further illustrated by the following examples, which set forth particularly advantageous method embodiments. While the examples are provided to illustrate the present invention, they are not intended to limit it.

As used herein, the following abbreviations have the following meanings. If not defined, the abbreviation will have its art recognized meaning.

g=gram

IR=infra-red

Mg=milligrams mm=millimeters

NTU or ntu=nephelometric turbidity unit

TBN=total base number

In addition, all percents recited below are weight percents based on the total weight of the composition described unless indicated otherwise.

Example 1

Hydrated potassium borate compositions of this invention generally can be prepared by dehydrating a water-in-oil emulsion of an aqueous solution of potassium hydroxide and boric acid. Preferably a solution is prepared having a potassium to boron ratio of 1 to 3. This solution is then added to a combination of neutral oil, dispersant, and/or a detergent and mixed to form an emulsion. The resulting emulsion is heated to remove water, and to partially dehydrate the potassium borates. Reduced pressures can also be used and the temperature set accordingly. During dehydration of the emulsion there is an initial period when water is removed from the emulsion at a rapid rate at a constant temperature for example at about 102° C. After this period, nearly all process water has been eliminated and water removed after this stage is due to the dehydration of the hydrated borate oligomer. Then the temperature slowly increases and the emulsion changes from turbid to clear. As the degree of dehydration and temperature continue to increase, the resulting liquid will again become turbid. As used in these examples, the following equipment was used to measure the experimental data:

Turbidity

Turbidity of the finished oils was measured, neat, at 20° C. using a Hach Ratio Turbidimeter Model: 18900. The turbidimeter was calibrated with 18 and 180 ntu Formazin primary standards.

Total Base Number (TBN)

TBN's were measured by ASTM method D2896 using a Brinkmann 682 Titroprocessor.

Particle Size Distribution (PSD)

Particle size distributions were measured on a Horiba LA-920 Particle Size Analyzer running Horiba LA-920 software with the relative refractive index set at "126A000I." filtered kerosene (0.45 micron filter) was used as a diluent.

Dispersed Hydrated Potassium Borate Compositions

A dispersed hydrated potassium borate composition was prepared by dehydration of an oil-in-water emulsion of aqueous potassium borate and dispersant/detergent oil solution by heating it to 132° C. over about 3 hours. The aqueous solution was prepared in a 2 liter glass beaker by stirring and heating: 272.8 g of deionized water, 219.6 g of 99.5% Boric Acid (EMScience), and 148.3 g of 45% Potassium Hydroxide in water (VWR, until the boric acid completely dissolved. Oil-in-water emulsions were made by gradually adding the aqueous phase to an oil phase containing: 272.3 g of Exxon 150 Neutral oil, a group I base oil, 60.5 g of an alkenyl succinimide having a molecular weight of about 1100 amu, and 26.5 g of a neutral calcium sulfonate having a TBN of about 5 mgKOH/g, under a vigorous mixing action. A high shear mixer is preferred to form an emulsion or a micro-emulsion. The emulsion was then dehydrated in a 1.5-liter stainless steel kettle equipped with a mechanical stirrer, heat mantle, temperature controller, and nitrogen sweep line.

Dehydration Monitored by in-situ Infra-red (IR) Measurement

IR data was collected using an in-situ probe during the dehydration of an emulsion. The kettle was equipped with an in situ ReactIR MP mobile IR probe manufactured by Applied Systems Inc.; the probe is a six reflection diamond coated ZnSe ATR element. An IR spectrum was collected every five minutes using ReactIR software, also manufactured by Applied Systems Inc., so that peak heights/areas could be tracked over the course of the reaction. These peak heights/areas were then plotted over time. Samples were taken at various times during dehydration. Turbidity was measured and the OH:B ratio was calculated as shown above. The dispersed hydrated potassium borate composition was analyzed for turbidity and OH:B ratio, the results of which are reported below:

| | Turbidity, ntu | OH:B ratio | K:B ratio |
|---|---|---|---|
| Dispersed Hydrated Potassium Borate Of Example 1 | 29.0 | 1.5:1 | 1:3 |

Following the procedure of Example 1, a second dispersed hydrated potassium borate composition, identified as Example 1A, was prepared and analyzed for turbidity and OH:B ratio, the results of which are reported below:

| | Turbidity, ntu | OH:B ratio | K:B ratio |
|---|---|---|---|
| Dispersed Hydrated Potassium Borate Of Example 1A | 28.5 | 1.3:1 | 1:3 |

The above data demonstrates that the dispersed hydrated potassium borate compositions having a hydroxyl:boron ratio (OH:B) of from at least 1.2:1 to 2.2:1, and a potassium to boron ratio of from about 1:2.75 to 1:3.25 can be prepared to have a turbidity value of less than 300 ntu.

Example 2

The dispersed, hydrated potassium borate of Example 1 was formulated into a lubricant composition comprising the following:

(a) 97 g of about an 87:13 mixture of 600 N/bright stock oil which further comprised conventional additives. See, for example, Salentine[13], U.S. Pat. No. 4,717,490.

(b) 3 g of the composition of Example 1.

The above lubricant composition is referred to herein as "Composition of Example 1".

The dispersed hydrated potassium borate of Example 1A was formulated into a lubricant composition in the same manner as Example 1. This lubricant composition is referred to herein as "Composition of Example 1A".

A commercially available dispersed hydrated potassium borate having an OH:B ratio of about 0.8:1 was formulated using the same additives and base stock as above to provide a comparative lubricant composition. This composition is referred to herein as "Comparative Composition".

The above compositions were employed in similar gear sets and these gear sets were then evaluated under identical conditions in a high temperature L-37 test (described by Schlemann, et al., SAE Technical Paper Series 831732) wherein the low speed, high torque operation of this test was conducted for about 16 hours at 163° C. This test measures wear in the gear set as well as the extent of surface fatigue exemplified by ridging and pitting in the gear sets after operation and is construed as a severe test that evaluates the performance of the lubricant composition in inhibiting gear set wear and fatigue. The results of this test are measured on a scale of 0 to 10 where lower numbers reflect more heavy or severe wear and fatigue in the gear sets and higher numbers reflect little or no wear or fatigue.

The results of this evaluation are set forth below:

| | Wear | | Ridging | | Pitting | |
|---|---|---|---|---|---|---|
| | Pinion Gear | Ring Gear | Pinion Gear | Ring Gear | Pinion Gear | Ring Gear |
| Comparative Composition[1] | 3 | 5 | 4 | 5 | 5 | 7 |
| Composition of Ex. 1 | 7 | 9 | 9 | 9 | 9 | 10 |
| Composition of Ex. 1A | 7 | 8 | 9 | 9 | 9 | 9 |

[1]Average of three runs.

The above data demonstrates that the compositions of this invention significantly inhibit wear and fatigue in gear sets operated at high temperatures, and show a marked improvement over the comparative composition.

From the foregoing description, various modifications and changes in the above described invention will occur to those skilled in the art. All such modifications coming within the scope of the appended claims are intended to be included therein.

What is claimed is:

1. A dispersed hydrated potassium borate composition comprising a hydrated potassium borate, a dispersant, and an oil of lubrication viscosity wherein said hydrated potassium borate is characterized by a hydroxyl:boron ratio (OH:B) of from at least 1.2:1 to about 1.5:1, a potassium to boron ratio of from about 1:2.75 to 1:3.25 and a turbidity value of less than about 75 ntu.

2. The composition according to claim 1, wherein the dispersed hydrated potassium borate has a potassium to boron ratio of from about 1:2.9 to about 1:3.1.

3. The composition according to claim 1, wherein the dispersed hydrated potassium borate has a potassium to boron ratio of about 1:3.

4. The composition according to claim 1, wherein said composition further comprises from about 0.001 moles to about 0.11 moles of a water soluble oxo anion per mole of boron atom.

5. The composition according to claim 4, wherein said water-soluble oxo anion is selected from the group consisting of nitrate, sulfate, carbonate, phosphate, pyrophosphate, silicate, aluminate, germanate, stannate, zincate, plumbate, titanate, molybdate, tungstate, vanadate, niobate, tantalate, uranates, isopolymolybdates, isopolytungstates, heteropolymolybdates, heteropolytungstates, and mixtures thereof.

6. The composition according to claim 1, wherein said dispersant is selected from the group consisting of a polyalkylene succinimide, a polyalkyene succinic anhydride, a polyalkylene succinic acid, a mono- or di-salt of a polyalkylene succinic acid and mixtures thereof.

7. The composition according to claim 6 wherein said composition comprises 2 to 40 weight percent of said dispersant, based upon the total weight of the composition.

8. The composition according to claim 1, wherein said composition further comprises 0.2 to 10 weight percent of a detergent, based upon the total weight of the composition.

9. An additive package comprising:

(a) from about 10 to 80 weight percent of the dispersed hydrated potassium borate composition according to claim 1; and (b) from about 20 to 90 weight percent of one or more additives selected from the group consisting of ashless dispersants, detergents, sulfurized hydrocarbons, dialkyl hydrogen phosphates, zinc dithiophosphates, alkyl ammonium phosphates, alkylammonium thiophosphates, alkylammonium dithiophosphates, phosphites, fatty acid esters of polyalcohols, 2,5-dimercapto thiadiazole, benzotriazole, dispersed molybdenum disulfide, foam inhibitors, and imidazolines; wherein the weight percent of each component is based on the total weight of the composition.

10. A finished oil composition comprising:

(a) from about 2 to 15 weight percent of the additive package of claim 9; and (b) from about 85 to 98 weight percent of an oil of lubricating viscosity, wherein the weight percent of each component is based on the total weigh of the composition.

11. The finished oil composition according to claim 10, which further comprises a viscosity index improver and/or a pour point depressant.

12. A method for providing lower turbidity for oil compositions comprising a potassium metal borate and a dispersant which method comprises forming a dispersed hydrated potassium borate composition with an oil of lubricating viscosity, a dispersant and an anti-wear effective amount of a hydrated potassium borate wherein said dispersed hydrated potassium borate composition is selected to have a hydroxyl:boron ratio (OH:B) of from at least 1.2:1 to about 1.5:1, a potassium to boron ratio of from about 1:2.75 to 1:3.25 and a turbidity of less than about 75 ntu.

13. A method for inhibiting gear damage, as measured by reduced wear and metal fatigue associated with ridging and pitting, during operation of a gear set at a temperature of at least 163° C., which method comprises operating said gear set with a dispersed, hydrated, potassium borate composition comprising:

(a) a hydrated potassium borate, (b) a dispersant, and (c) an oil of lubricating viscosity, wherein the dispersed, hydrated potassium borate composition is characterized by a hydroxyl:boron ratio (OH:B) of from at least 1.2:1 to about 1.5:1, a potassium to boron ratio of from about 1:2.75 to 1:3.25 and a turbidity value of less than about 75 ntu.

14. A method for the preparation of a dispersed hydrated potassium borate composition which comprises:

(1) mixing, under agitation, a mixture comprising:

(a) an aqueous solution of boric acid and potassium hydroxide wherein the stoichiometric ratio of reagants are selected to provide a potassium to boron ratio in the product of from about 1:2.75 to 1:3.25, (b) an oil of lubricating viscosity; and (c) a dispersant; and then, (2) heating the mixture to remove sufficient water so as to produce a dispersed hydrated potassium borate composition having a hydroxyl: boron ratio (OH:B) of from at least 1.2:1 to about 1.5:1 and a turbidity of less than about 75 ntu.

* * * * *